US008640615B2

(12) United States Patent
Miyahara et al.

(10) Patent No.: US 8,640,615 B2
(45) Date of Patent: Feb. 4, 2014

(54) SCREEN PRINTING MACHINE AND METHOD FOR CONTROLLING INSIDE TEMPERATURE OF SCREEN PRINTING MACHINE

(75) Inventors: Seiichi Miyahara, Yamanashi (JP); Kimiyuki Yamasaki, Fukuoka (JP); Minoru Murakami, Yamanashi (JP); Takahiro Fukagawa, Yamanashi (JP); Takashi Yazawa, Yamanashi (JP); Nobuhiro Nakai, Yamanashi (JP)

(73) Assignee: Panasonic Corporation, Osaka (JP)

( * ) Notice: Subject to any disclaimer, the term of this patent is extended or adjusted under 35 U.S.C. 154(b) by 315 days.

(21) Appl. No.: 13/133,812

(22) PCT Filed: Oct. 23, 2009

(86) PCT No.: PCT/JP2009/005616
§ 371 (c)(1),
(2), (4) Date: Jun. 9, 2011

(87) PCT Pub. No.: WO2010/070801
PCT Pub. Date: Jun. 24, 2010

(65) Prior Publication Data

US 2011/0239878 A1 Oct. 6, 2011

(30) Foreign Application Priority Data

Dec. 16, 2008 (JP) ..... 2008-319224

(51) Int. Cl.
*B05C 17/04* (2006.01)

(52) U.S. Cl.
USPC ..... 101/123; 101/129; 101/484

(58) Field of Classification Search
USPC ..... 101/114, 123, 129, 484
See application file for complete search history.

(56) References Cited

U.S. PATENT DOCUMENTS

| | | | | |
|---|---|---|---|---|
| 5,588,360 | A | 12/1996 | Kurz | |
| 6,336,402 | B1 * | 1/2002 | Tomomatsu et al. | 101/129 |
| 7,984,984 | B2 * | 7/2011 | Kitahara | 347/104 |
| 2003/0131741 | A1 | 7/2003 | Kawakita | |

FOREIGN PATENT DOCUMENTS

| | | | |
|---|---|---|---|
| CN | 1432469 | A | 7/2003 |
| JP | 04236494 | A | 8/1992 |
| JP | 06-316053 | A | 11/1994 |

(Continued)

OTHER PUBLICATIONS

United Kingdom Office Action for application GB1109686.4 dated May 22, 2012.

(Continued)

*Primary Examiner* — Ren Yan
(74) *Attorney, Agent, or Firm* — Pearne & Gordon LLP

(57) ABSTRACT

An object of the invention to provide a screen printing machine allows, during maintenance work for one printing device, the other printing device to continue its screen printing work, and a method for controlling an inside temperature of a screen printing machine. A space surrounded by a base (12) and a cover member (11) is divided into two portions by a partition member (14), and two printing devices (13) are accommodated in two working compartments (15), respectively, which are defined by the base (12), the cover member (11) and the partition member (14), whereby temperature-controlled air is blown into each of the working compartments (15) via an air pipe (71) which branches into two air vents (72) opened to the respective working compartments (15).

4 Claims, 8 Drawing Sheets

(56) References Cited

FOREIGN PATENT DOCUMENTS

| | | | |
|---|---|---|---|
| JP | 2005-081745 | A | 3/2005 |
| JP | 2007-168090 | A | 7/2007 |
| JP | 2008-117975 | A | 5/2008 |
| JP | 2008-134888 | A | 6/2008 |
| WO | 87/06882 | A1 | 11/1987 |
| WO | 03/101738 | A1 | 12/2003 |

OTHER PUBLICATIONS

International Search Report for PCT/JP2009/005616 dated Feb. 23, 2010.

Chinese Office Action for Application No. 200980150467.1 dated Mar. 20, 2013.

* cited by examiner

SCREEN PRINTING MACHINE AND METHOD FOR CONTROLLING INSIDE TEMPERATURE OF SCREEN PRINTING MACHINE

TECHNICAL FIELD

The present invention relates to a screen printing machine including two printing devices within a space surrounded by a base and a cover member and a method for controlling temperature in a compartment of a screen printing machine.

BACKGROUND ART

A screen printing machine includes a printing device provided on a base. The printing device includes a board positioning mechanism, a mask plate, a squeegee, a paste supply cylinder and the like and is configured to execute screen printing work on a board which is conveyed and positioned by a board conveying path. In the screen printing machine as described above, a portion above the base is covered by a cover member, and the printing device is accommodated within a working compartment formed in a space defined by the base and the cover member.

In the screen printing work, the temperature within the working compartment needs to be controlled from the reason that the viscosity of paste is maintained at a proper value so as to ensure a constant quality. Because of this, there is a screen printing machine which includes a blower unit for blowing temperature-controlled air into a working compartment (Patent Document 1).

On the other hand, among screen printing machines, there is provided a type of screen printing machine in which two printing devices are provided within a space surrounded by a base and a cover member such that these two printing machines can simultaneously perform respective screen printing operations. In a screen printing machine, an access door is provided in a cover member which is used when the operator performs maintenance work on the printing device, whereby the operator opens this access door to allow access to the printing device. In the printing machine including the two printing devices provided on the base, a plurality of access doors are provided in positions which correspond to the printing devices so as to give access to the respective printing devices.

RELATED ART DOCUMENTS

Patent Documents

Patent Document 1: JP-A-2007-168090

SUMMARY OF THE INVENTION

Problem to be Solved by the Invention

In the screen printing machine including the two printing devices provided within the space surrounded by the base and the cover member, when the operator opens one of the access doors for a corresponding one of the printing devices on which the operator attempts to perform maintenance work, the temperature of the space in whole changes through an opening portion of the cover member which is formed by opening the access door. The change of the temperature affects the screen printing work by the other printing device on which no maintenance work is attempted to be performed (for example, the quality of the paste being used is deteriorated). Because of this, when the maintenance work is performed on one of the printing devices, no printing work can be performed by the other printing device, which results in a problem that the workability is reduced largely.

An object of the invention is to provided a screen printing machine which enables, while maintenance work is being performed on one of two printing devices, the other printing device to continue its printing work, and a method for controlling an inside temperature of a screen printing machine.

Means for Solving the Problem

A screen printing machine recited in claim 1 includes: a base; a cover member provided so as to cover a portion above the base; a partition member which divides a space surrounded by the base and the cover member; two printing devices which are accommodated in two working compartments, respectively, defined by the base, the cover member and the partition member, and which are configured to execute printing work on boards independently of each other; an air pipe which branches into two air vents opened to the respective working compartments; and a blower unit configured to blow out temperature-controlled air into each of the working compartments via the air pipe.

A screen printing machine recited in claim 2 is the screen printing machine according to claim 1 including: a plurality of access doors provided for the respective working compartments so as to allow access to the working compartment from outside; door open/close detection means for detecting an opened/closed state of each of the access doors; target inside temperature setting means for setting a target inside temperature which is common to the two working compartments; inside temperature detection means for detecting inside temperatures of the working compartments; and a control unit configured to control a temperature of air blown out by the blower unit such that: when the door open/close detection means detects that all of the plurality of access doors are not opened, one of the inside temperatures of the two working compartments which is detected by the inside temperature detection means becomes the temperature set by the target inside temperature setting means; and when the door open/close detection means detects that any of the plurality of access doors is opened, the inside temperature of the working compartment for which the access door is not opened, of the inside temperatures of the two working compartments detected by the inside temperature detection means, becomes the target inside temperature set by the target inside temperature setting means.

A method for controlling inside temperature of a screen printing machine, recited in claim 3, which includes a base, a cover member provided so as to cover a portion above the base, a partition member which divides a space surrounded by the base and the cover member, and two printing devices accommodated in two working compartments, respectively, defined by the base, the cover member and the partition member, and configured to execute printing work on boards independently of each other, said method including: blowing temperature-controlled air into each of the working compartments by a blower unit via an air pipe which branches into two air vents opened to the respective working compartments.

A method for controlling inside temperature of a screen printing machine, recited in claim 4, is the method for controlling inside temperature of the screen printing machine according to claim 3, including: controlling a temperature of air blown out by the blower unit such that: when all of a plurality of access doors provided for the respective working compartments and configured to allow access to the respective working compartments from outside are not opened, one of the inside temperatures of the two working compartments becomes a target inside temperature set to be common to the two working compartments; and when any of the plurality of access doors is opened, the inside temperature of the working compartment for which the access door is not opened, of the inside temperatures of the two working compartments, becomes the target inside temperature.

Advantages of the Invention

In the invention, the space surrounded by the base and the cover member is divided into the two working compartments by the partition member. The two printing devices are accommodated in the defined two working compartments, respectively, and the temperature-controlled air is blown into the working compartments via the air pipe which branches into the two air vents opened to the respective working compartments. Therefore, even when the access door corresponding to one of the printing devices is opened whereby the inside temperature of the working compartment accommodating the one printing device changes, the inside temperature in the working compartment accommodating the other printing hardly changes. In the screen printing work, the temperatures of the working compartments need to be maintained at a set predetermined temperature from the reason that the viscosity of the paste used is maintained at the proper value so as to ensure the constant quality. Nevertheless, even when the access door leading to one of the working compartment is opened, the inside temperature in the other working compartment hardly changes. Therefore, while the maintenance work is being performed on the one of the printing devices, the other printing device can continue its printing work, thereby making it possible to increase the workability accordingly.

MODE FOR CARRYING OUT THE INVENTION

Embodiment 1

Figure 1:
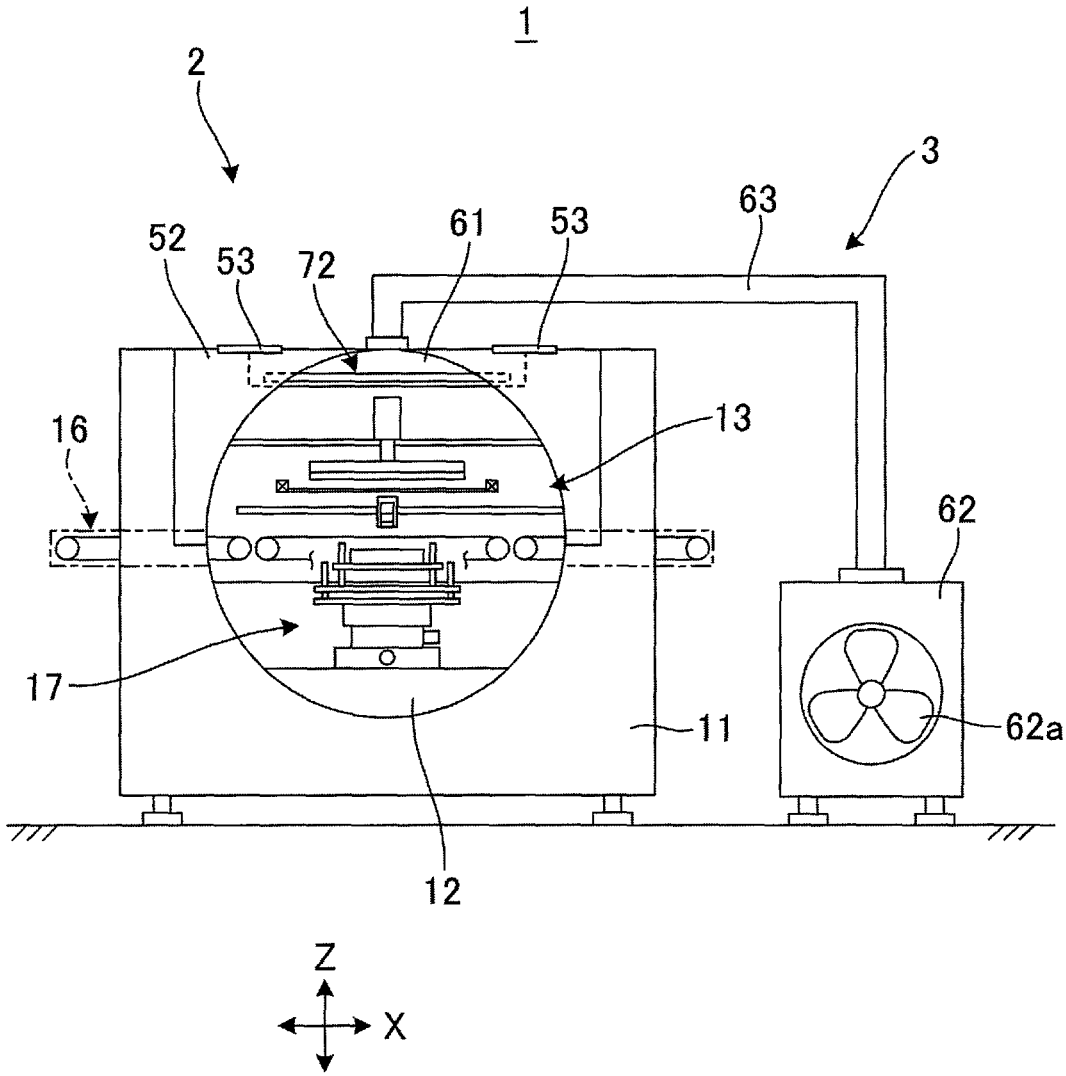
FIG. 1 is a partial sectional side view of a screen printing machine according to Embodiment 1 of the invention.
Figure 2:
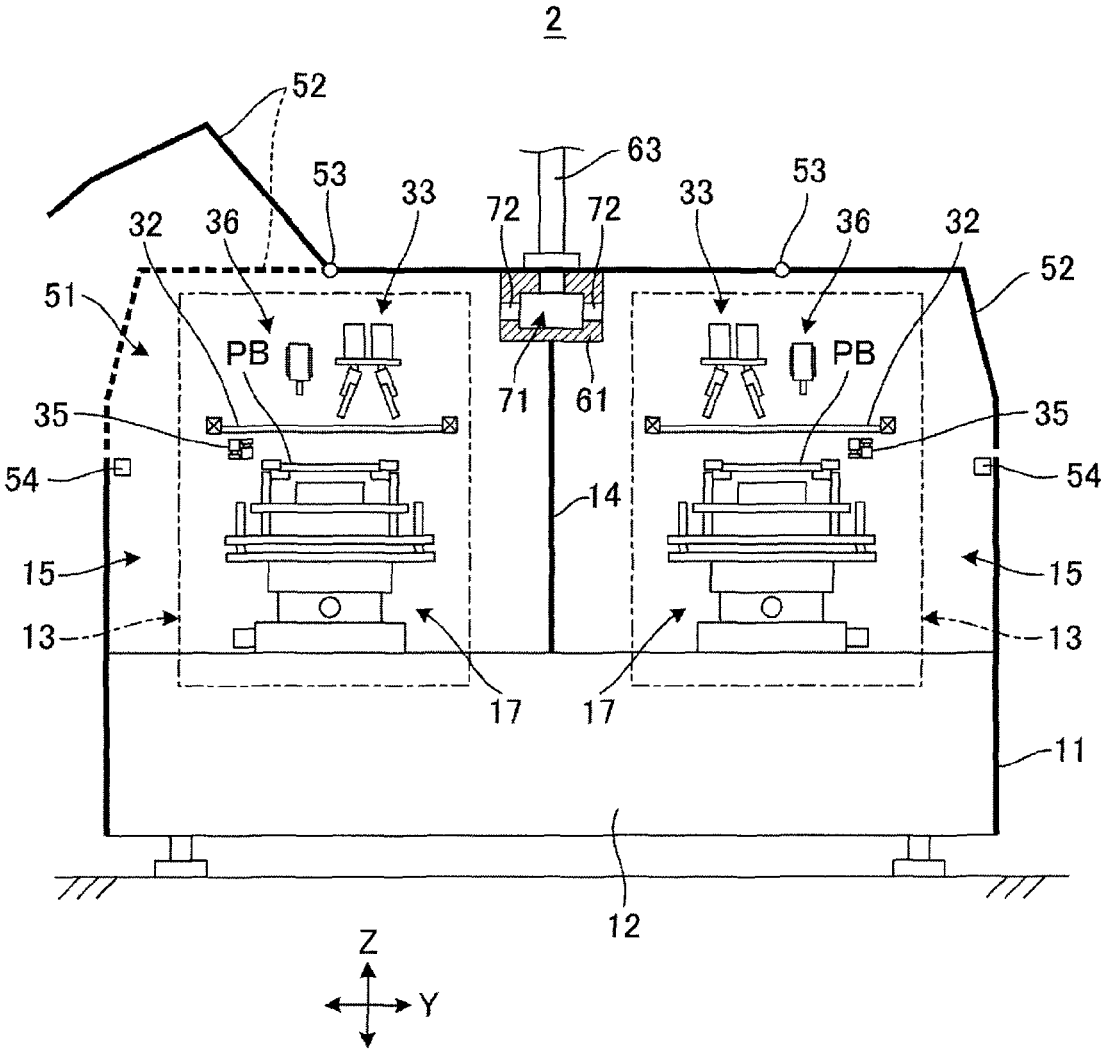
FIG. 2 is a sectional front view of the screen printing machine according to Embodiment 1 of the invention.
Figure 3:
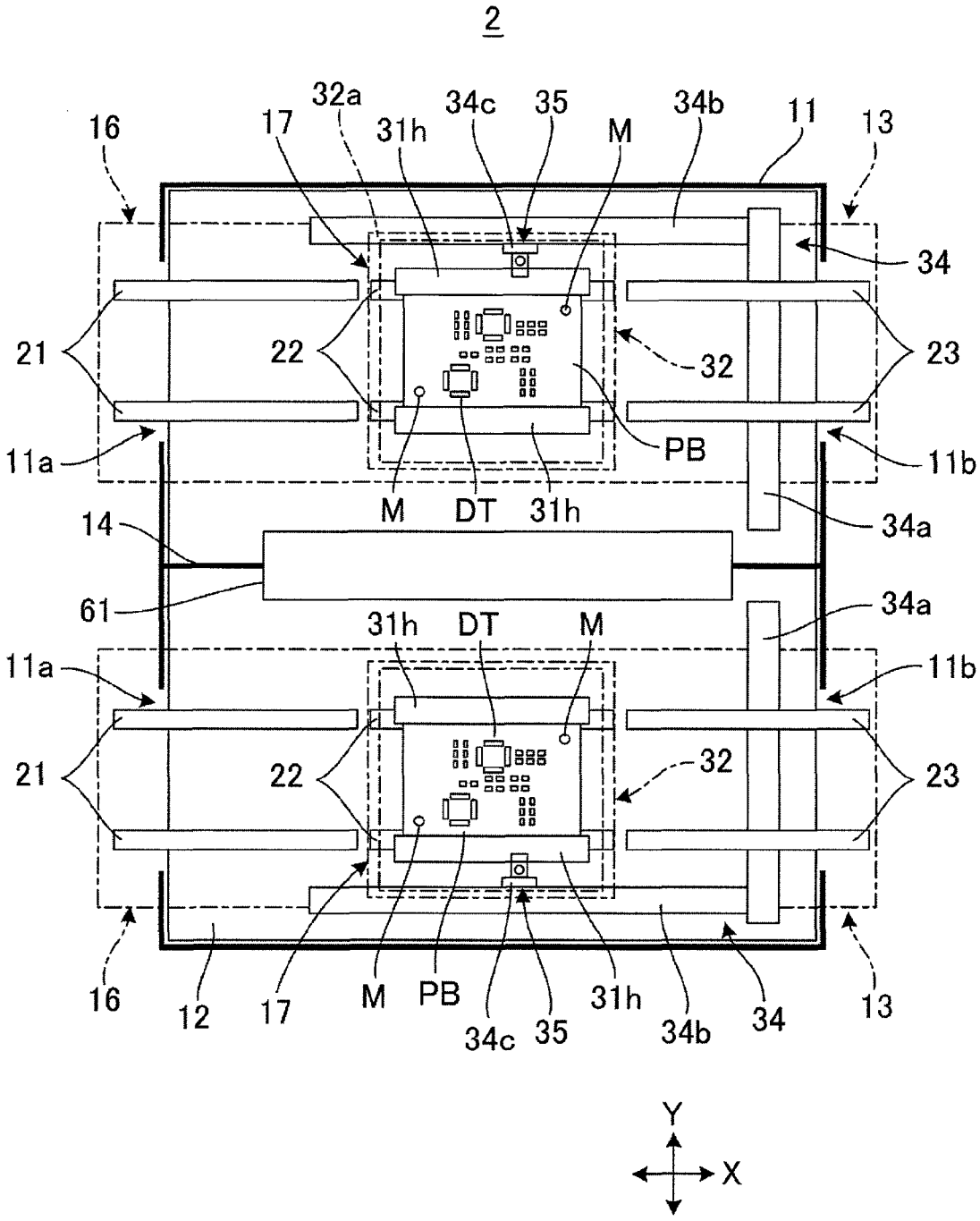
FIG. 3 is a sectional plan view of the screen printing machine according to Embodiment 1 of the invention.
Figure 4:
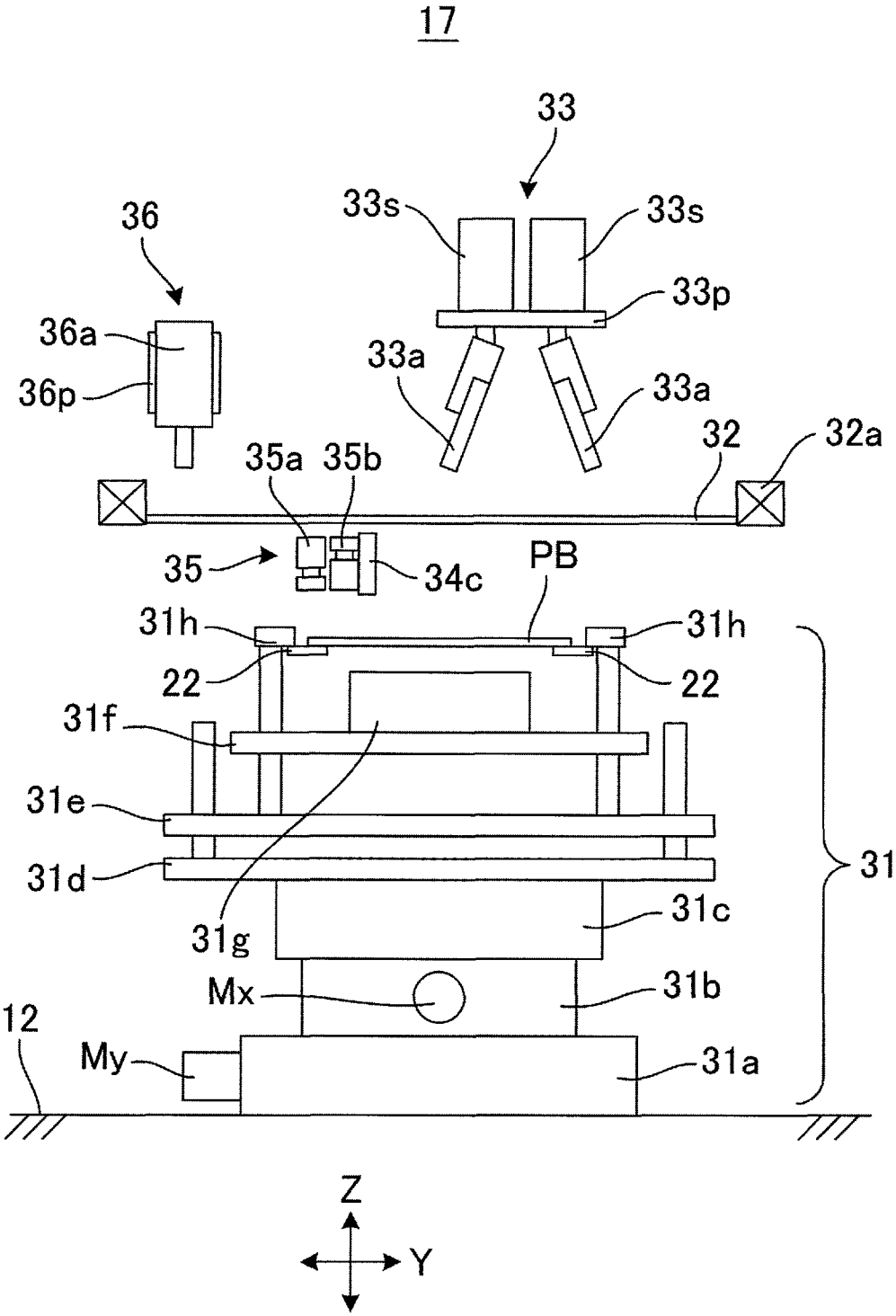
FIG. 4 is a front view of a printing work execution unit configuring the screen printing machine according to Embodiment 1 of the invention.
Figure 5:
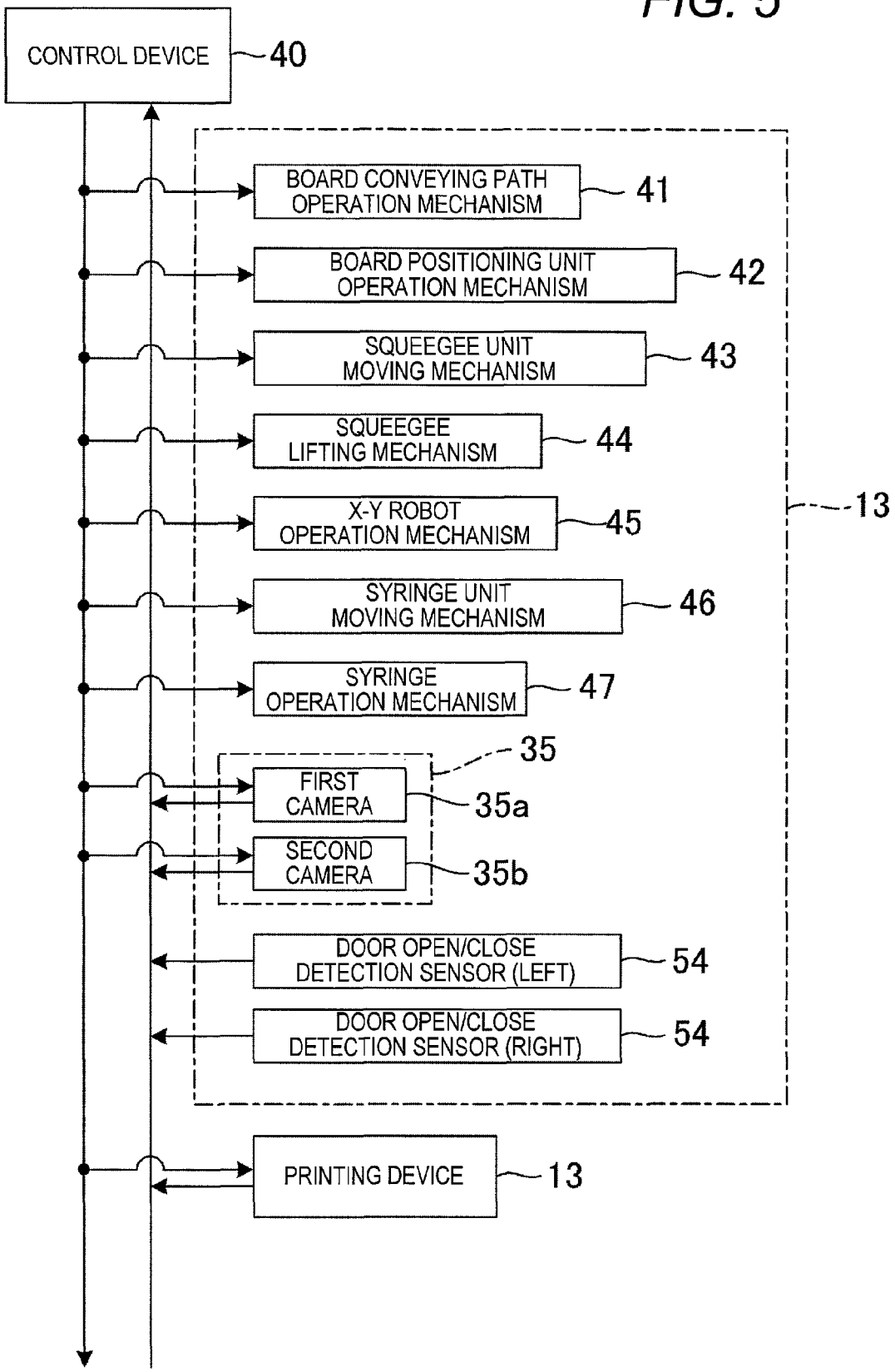
FIG. 5 is a block diagram showing a control system of the screen printing machine according to Embodiment 1 of the invention.
Figure 6:
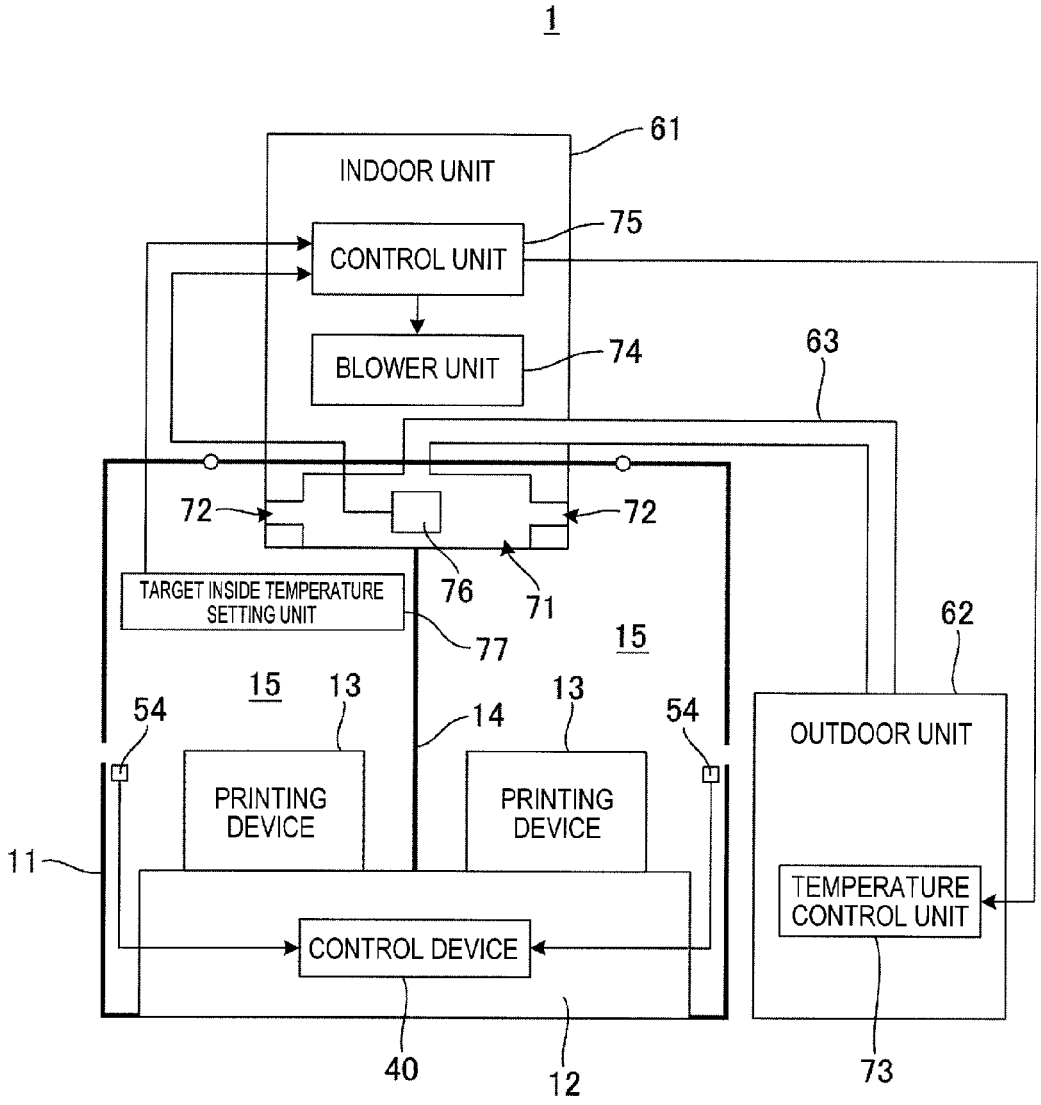
FIG. 6 is a block diagram of a temperature control unit provided in the screen printing machine according to Embodiment 1 of the invention.
Figure 7A:
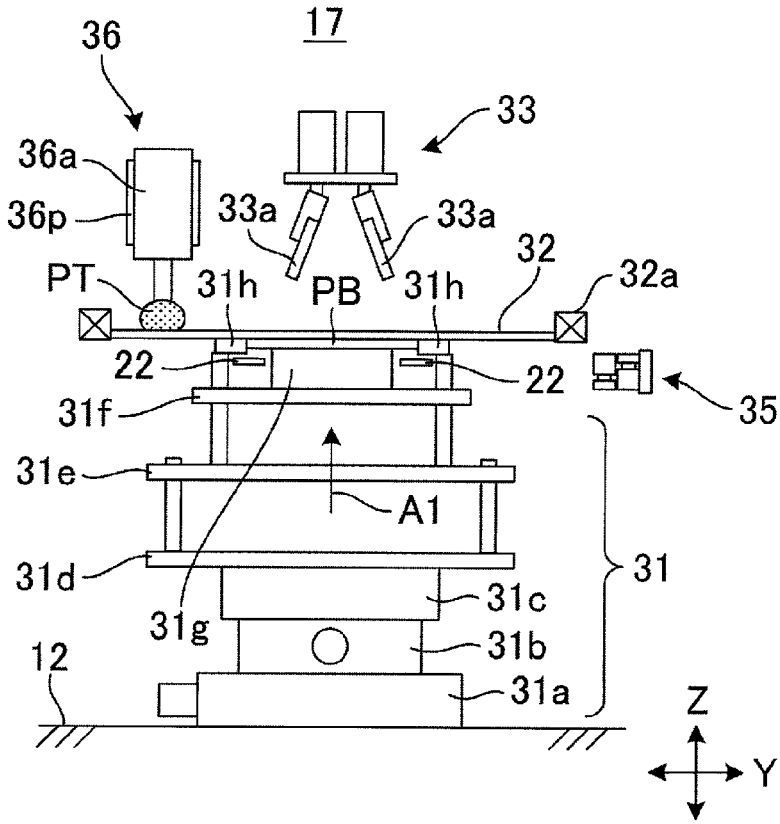
FIGS. 7(*a*) and 7(*b*) are operation diagrams of the printing work execution unit configuring the screen printing machine according to Embodiment 1 of the invention.
Figure 7B:
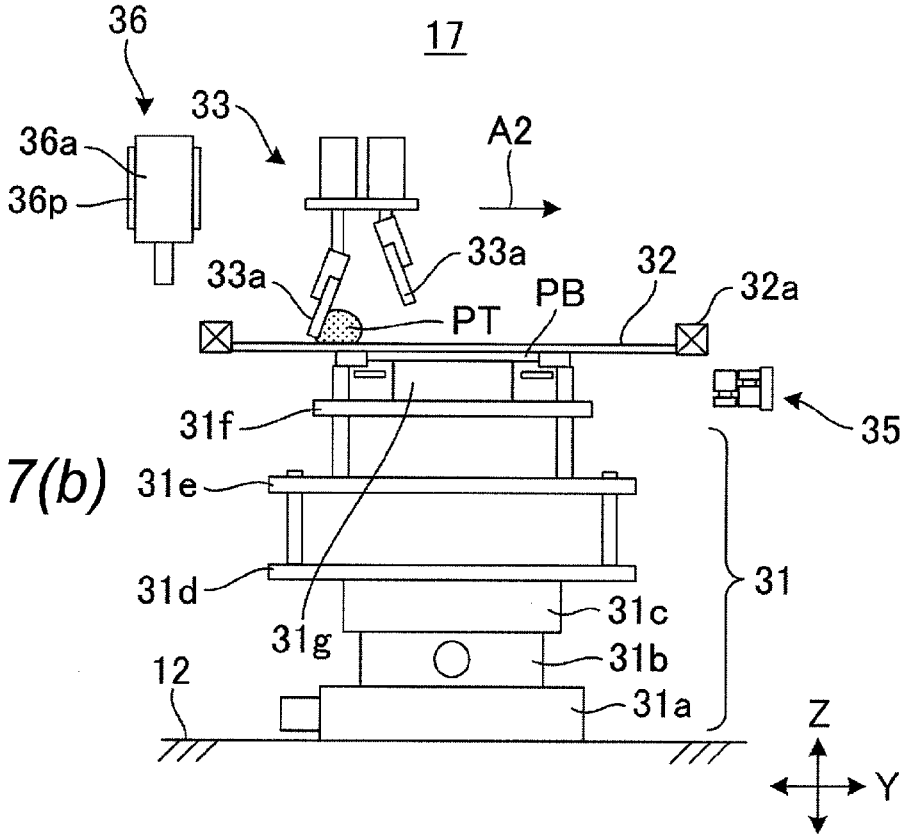

FIG. 1 is a partial sectional side view of a screen printing machine according to Embodiment 1 of the invention, FIG. 2 is a sectional front view of the screen printing machine according to Embodiment 1 of the invention, FIG. 3 is a sectional plan view of the screen printing machine according to Embodiment 1 of the invention, FIG. 4 is a front view of a printing work execution unit configuring the screen printing machine according to Embodiment 1 of the invention, FIG. 5 is a block diagram showing a control system of the screen printing machine according to Embodiment 1 of the invention, FIG. 6 is a block diagram of a temperature control unit provided in the screen printing machine according to Embodiment 1 of the invention, and FIGS. 7(*a*) and 7(*b*) are operation diagrams of the printing work execution unit configuring the screen printing machine according to Embodiment 1 of the invention.

In FIG. 1, a screen printing machine 1 includes a main body portion 2 and a temperature control unit 3. The main body portion 2 conveys a board PB in one direction in a horizontal plane and positions the board PB, and executes screen printing work. The temperature control unit 3 controls a temperature in a space in the main body portion 2. In the following description, the conveying direction of the board PB in the main body portion 2 is referred to as an X-axis direction, and a direction perpendicular to the X-axis direction in the horizontal plane is referred to as a Y-axis direction. In addition, a vertical direction is referred to as a Z-axis direction.

In FIGS. 1, 2 and 3, the main body portion 2 includes: a base 12 covered by a cover member 11; and two printing devices 13 provided on the base 12.

In FIGS. 2 and 3, a partition member 14 is provided to extend in the vertical direction within a space surrounded by the base 12 and the cover member 11 so as to divide the space into two portions in the Y-axis direction. Two working compartments 15 are defined by the base 12, the cover member 11 and the partition member 14, and the two printing devices 13 are accommodated individually in the respective working compartments 15.

Each of the printing devices 13 includes: a board conveying path 16 provided on the base 12 to convey a board PB in the direction in the horizontal plane; and a printing work execution part 17 configured to execute screen printing work on the board PB conveyed and positioned by the board conveying path 16.

In FIG. 3, each board conveying path 16 includes a feeding conveyor 21, a positioning conveyor 22 and a discharge conveyor 23 which are provided side by side in the X-axis direction. The feeding conveyor 22 feeds a board PB input from an outside of the main body portion 2 via a board input opening 11*a* provided in the cover member 11 to an inside of the main body portion and conveys the board PB to the positioning conveyor 22. The positioning conveyor 22 positions the board PB received from the feeding conveyor 21 in a work execution position (the position of the board PB shown in FIG. 3), and after completion of screen printing work on the board PB, conveys the board PB (i.e., the board PB on which screen printing has been applied) to the discharge conveyor 23. The discharge conveyor 23 discharges the board PB received from the positioning conveyor 22 to the outside of the main body portion 21 via a board discharge opening 11*b* provided in the cover member 11.

In FIG. 4, each printing work execution part 17 includes: a board positioning unit 31 configured to clamp the board PB positioned by the board conveying path 16 (the positioning conveyor 22) so as to position a positioning of the board PB in the directions (the X-axis direction and the Y-axis direction) in the horizontal plane and also to position the board PB in the vertical direction (the Z-axis direction); a mask plate 32 and a squeegee unit 33 which are provided above the board positioning unit 31; a camera unit 35 provided movable in the directions in the horizontal plane within a space defined between the board positioning unit 31 and the mask plate 32 by an X-Y robot 34 (FIG. 3); and a syringe unit 36 configured to supply paste such as a soldering paste or a conductive paste to the mask plate 32.

In FIG. 4, the board positioning unit 31 of each printing work execution part 17 includes: a Y-table 31*a* configured to move relative to the base 12 in the Y-axis direction; an X-table 31*b* configured to move relative to the Y-table 31*a* in the X-axis direction, a θ-table 31*c* configured to rotate relative to the X-table 31*b* about the Z-axis (within the horizontal plane); a base plate 31*d* fixed to the θ-table 31*c*; a first lifting plate 31*e* configured to be raised and lowered relative to the base plate 31*d*; a second lifting plate 31*f* configured to be raised and lowered relative to the first lifting plate 31*e*; a supporting unit 31*g* fixed to the second lifting plate 31*f*; and a clamper 31*h* including a pair of members configured to open and close on the board positioning conveyers 22 in the Y-axis direction (also see FIG. 3).

In FIGS. 3 and 4, four sides of the mask plate 32 is supported by a mask frame 32*a* having a rectangular shape in plan view. In an inner region of the mask plate 32 surrounded by the mask frame 32*a*, a large number of pores are provided so as to correspond to shapes and positions of electrodes DT (FIG. 3) formed on an upper surface of the board PB serving as an object to be printed. The mask plate 32 is installed in a predetermined mask installation position (the position shown in FIGS. 3 and 4) located above the board positioning unit 31.

In FIG. 4, the squeegee unit 33 includes: a movable plate 33*p* provided so as to move relative to the board positioning unit 31 in the Y-axis direction; two squeegee lifting cylinders (pneumatic cylinders) 33*s* which are attached to the movable plate 33*p* so as to extend in the vertical direction; and two squeegees 33*a* which are attached to respective lower portions of the squeegee lifting cylinders 33*s* so as to oppose each other in the Y-axis direction. Each of the squeegees 33*a* is a member shaped like a "paddle" extending in the X-axis direction and is configured to be raised and lowered relative to the movable plate 33*p* through protruding and retracting actions of the squeegee lifting cylinders 33*s* with respect to the downward direction.

In FIG. 3, the X-Y robot 34 includes: a Y-axis stage 34*a* which extends in the Y-axis direction over the base 12 and which is provided fixedly relative to the base 12; an X-axis stage 34*b* which extends in the X-axis direction and which is provided movably along the Y-axis stage 34*a*; and a movable plate 34*c* which is provided movably along the X-axis stage 34*b*. In FIG. 4, the camera unit 35 includes a first camera 35 having an image incident surface of a first camera 35*a* directed downward and a second camera 35*b* having an image incident surface directed upward, which are attached to the movable plate 34*c* of the X-Y robot 34.

In FIG. 4, the syringe unit 36 includes: a movable plate 36*p* which is provided movably in the directions within the horizontal plane relative to the board positioning unit 31; and a syringe 36*a* configured to downwardly eject paste to be printed on the board PB and attached to the movable plate 36*p*.

The conveying and positioning operation of a board PB by the feeding conveyor 21, the positioning conveyor 22 and the discharge conveyor 23, which configure the board conveying path 16, is implemented by controlling the operation of a board conveying path operation mechanism 41 (FIG. 5) including an actuator, not shown, by a control device 40 (FIG. 5) provided in the main body portion 2 of the screen printing machine 1.

Movements such as the movement of the Y table 31*a* in the Y-axis direction relative to the base 12, the movement of the X-table 31*b* in the X-axis direction relative to the Y-table 31*a*, the rotation of the θ table 31*c* about the Z-axis relative to the X table 31*b*, the lifting up and down of the first lifting plate 31*e* relative to the base plate 31*d* (namely, relative to the θ table 31*c*), the lifting up and down of the second lifting plate 31*f* relative to the first lifting plate 31*e* (namely, the supporting unit 31*g*), and the open/close of the clamper 31*h* are implemented by controlling the operation of a base plate positioning unit operation mechanism 42 (FIG. 5), which includes actuators such as a Y-table driving motor My and an X-table driving motor Mx (FIG. 4), by the control device 40.

The movement of the squeegee unit 33 (the movement of the movable plate 33*p*) is implemented by controlling the operation of the squeegee moving mechanism 43 (FIG. 5), which includes an actuator, not shown, by the control device 40, and the lifting up and down of each squeegee 33*a* is implemented by controlling the operation of a squeegee lifting mechanism 44 (FIG. 5), which includes the lifting cylinder 33*s*, by the control device 40.

The movement of the X-axis stage 34*b* in the Y-axis direction and the movement of the movable plate 34*c* in the X-axis direction are implemented by controlling the operation of an X-Y robot operation mechanism 45 (FIG. 5), which includes actuators, not shown, by the control device 40, the X-axis stage 34*b* and the movable plate 34*c* making up the X-Y robot 34.

The first camera 35*a* is controlled by the control device 40 so as to image a board position detection mark M (FIG. 3) provided on the board PB positioned by the board positioning unit 31 (FIG. 5). The second camera 35*b* is controlled by the control device 40 so as to image a mask position detection mark (not shown) provided on the mask plate 32 (FIG. 5). Image data obtained by the first camera 35*a* and image data obtained by the second camera 35*b* are input to the control device 40 (FIG. 5).

The movement of the syringe unit 36 (the movement of the movable plate 36*p*) is implemented by controlling the operation of a syringe unit moving mechanism 46 (FIG. 5), which includes an actuator, not shown, by the control device 40, and the supply of paste by the syringe 36 is implemented by controlling the operation of a syringe operation mechanism 47 (FIG. 5), which includes an actuator, not shown, by the control device 40.

In FIG. 2, access openings 51, which serve as opening portions through which the respective working compartments 15 can be accessed, are provided in the cover member 11 (FIG. 2 shows only an opening portion 51 provided on a left side of the drawing). As shown in FIGS. 1 and 2, for each of the access openings 51 connected to the corresponding working compartment 15, an access door 52 is provided so as to be opened and closed with respect to the access opening 51 about a hinge portion 53 as a fulcrum. Here, the access door 52 on the left side of FIG. 2 is configured to expose the working compartment 15 which accommodates the left printing device 13 to the outside of the main body portion 2 so as to allow the operator of the screen printing machine 1 to access to the left printing device 13, while an access door 52 on a right side of FIG. 2 is configured to expose the working compartment 15 which accommodates the right printing device 13 to the outside of the main body portion 2 so as to allow the operator to access to the right printing device 13.

In FIG. 2, two door open/close detection sensors 54 are provided on the cover member 11 for detecting a door opened/closed state of the respective access doors 52. Each of the door open/close detection sensors 54 includes, for example, a limit switch having a lever portion (not shown) which is operated by an open/close operation of the access door 52, and a detection signal (a signal indicating an opened/closed state of the access door 52) is input into the control device 40 (FIG. 5).

In FIGS. 1 and 6, the temperature control unit 3 includes: an indoor unit 61 provided in the main body portion; and an outdoor unit 62 provided at an exterior portion of the main body portion 2. The indoor unit 61 and the outdoor unit 62 are connected by an air duct 63.

In FIGS. 2 and 3, the indoor unit 61 is provided at an upper portion of the partition member 14 of the main body portion 2 so as to penetrate through the partition member 14 in the lateral direction. In FIG. 6, an air pipe 71 for connecting to the outdoor unit 62 via the air duct 63 is provided. The air pipe 71 branches into two air vents 72 which are opened to the respective working compartments 15.

In FIG. 6, a temperature control unit 73 is provided in the outdoor unit 62 for controlling the temperature of air that is sent through the air pipe 71 by driving an expansion valve, a compressor, a fan 62 (FIG. 1) and the like.

In FIG. 6, the indoor unit 61 includes: a blower unit 74 including a fan; and a control unit 75 for controlling the operations of the blower unit 74 and the temperature control unit 73 in the outdoor unit 62. An air temperature detection sensor 76 is provided within the air pipe 71.

In FIG. 6, a target inside temperature setting unit 77 is provided in one of the two working compartments 15, and the operator can set a target inside temperature common to the two working compartments 15 by the target inside temperature setting unit 77.

The control unit 75 in the indoor unit 61 compares the target inside temperature set by the target inside temperature setting unit 77 with the temperature of air within the air pipe 71 detected by the air temperature detection sensor 76 (hereinafter, referred to as a detected inside temperature) and operates the temperature control unit 73 so as to cause the detected inside temperature to coincide with the target inside temperature. With this configuration, air having a temperature set by the target inside temperature setting unit 77 is sent into the two working compartments 15, whereby the inside temperature of each of the working compartments 15 is maintained at the target inside temperature set by the operator using the target inside temperature setting unit 77.

When a detection unit, not shown, detects that a board PB is input into the board conveying path 16 (the feeding conveyor 21) from the operator (or another unit, not shown, which is provided on an upstream side of the main body portion 2), the control device 40 in the main body portion 2 of the screen printing machine 1 actuates the feeding conveyor 21 and the positioning conveyor 22 such that the feeding conveyor 21 receives the input board PB so as to feed the board PB into the main body portion 2 and delivers to the positioning conveyer 22. When the positioning conveyer 22 receives the board PB, the control device 40 continues to actuate the positioning conveyor 22 and stops the positioning conveyor 22 when the board PB reaches the work execution position so as to position the board PB in the work execution position (a board positioning process).

After positioning the board PB in the work execution position, the control device 40 causes the second lifting plate 31*f* of the board positioning unit 31 to rise relative to the first lifting plate 31*e* such that an upper surface of the supporting unit 31*g* contacts a lower surface of the board PB from therebelow whereby the supporting unit 31*g* supports the board PB. When the supporting unit 31*g* supports the board PB, the control device 40 causes the clamper 31*h* to clamp the board PB and causes the second lifting plate 31*f* to rise further so as to push up the board PB by the supporting unit 31*g*. Accordingly, the board PB is raised while opposing sides thereof are slid on the clamper 31*h*, and then is spaced upwards away from the positioning conveyor 22, thereby being fixed to the board positioning unit 31 in a state in which an upper surface of the board PB is flush with upper surfaces of both members of the clamper 31*h* (a board fixing process).

After fixing the board PB to the board positioning unit 31, the control device 40 moves the camera unit 35 and controls the imaging operation of the first camera 35*a* so as to obtain image data of the board position detection mark M on the board PB thereby determining the position of the board PB. The control device 40 moves the camera unit 35 and controls the imaging operation of the second camera unit 35*b* so as to obtain image data of the mask position detection mark on the mask plate 32 thereby determining the position of the mask plate 32.

After determining the position of the board PB and the position of the mask plate 32, the control device 40 positions the board PB in a predetermined position directly below the mask plate 32 by causing the board positioning unit 31 to move the board PB in the directions in the horizontal plane. Thereafter, the control device 40 causes the board positioning unit 31 to move the board PB in the vertical direction (to raise the first lifting plate 31*e*) such that the upper surface of the board PB contacts the lower surface of the mask plate 32 from therebelow (a direction indicated by an arrow A1 in FIG. 7(*a*)). Accordingly, the mask plate 32 is positioned with the board PB (FIG. 7(*a*), a board positioning process).

After positioning the board PB with the mask plate 32, the control device 40 executes screen printing on the board PB. To execute the screen printing, firstly, the syringe unit 36 is moved to a position above the mask plate 32 to supply paste PT to the upper surface of the mask plate 32 from the syringe 36*a* (FIG. 7(*a*), a paste supply process).

After supplying the paste PT on the upper surface of the mask plate 32, the control device 40 lowers one of the squeegees 33*a* such that a lower edge of the squeegee 33*a* contacts the upper surface of the mask plate 32. Then, the control device 40 moves the squeegee unit 33 in the Y-axis direction and draws the paste PT (in a direction indicated by an arrow A2 in FIG. 7(*b*)) by causing the squeegee 33*a* to slide over the mask plate 33*a* such that the paste PT is filled in pattern holes in the mask plate 32 (FIG. 7(*b*), a squeegeeing process).

Note that FIG. 7(*b*) shows how to draw the paste PT in the direction indicated by the arrow A2 by moving the left squeegee 33*a* shown in the drawing in the direction indicated by the arrow A2. When the paste PT is drawn in an opposite direction to the direction indicated by the arrow A2, the right squeegee 33*a* in the drawing contacts the upper surface of the mask plate 32, so that the squeegee unit 33 is moved in the opposite direction to the direction indicated by the arrow A2.

When filling the paste PT in the pattern holes in the mask plate 32, the control device 40 lowers the first lifting plate 31*e* so as to separate the board PB from the mask plate 32. Consequently, a so-called plate releasing is implemented, whereby the paste PT filled in the pattern holes in the mask plate 32 is printed (transferred) on the board PB (a plate releasing process).

When the printing work of the paste PT on the board PB is completed, the control device 40 opens the clamper 31*h* so as to release the clamping of the board PB and thereafter lowers the second lifting plate 31*f* so as to place the board PB on the positioning conveyor 22. Then, the control device 40 actuates the board positioning unit 31 to control the position of the positioning conveyor 22 relative to the discharge conveyor 23. When completing the position control of the positioning conveyor 22 relative to the discharge conveyor 23, the control device 40 actuates the positioning conveyor 22 and the discharge conveyor 23 so as to convey the board PB from the positioning conveyor 22 to the discharge conveyor 23 and controls further the discharge conveyor 23 so as to discharge the board PB to another device disposed on a downstream side of the main body portion 2 (a board discharge process).

In this way, the main body portion 2 of the screen printing machine 1 executes screen printing works on the boards PB by the respective two printing devices 13 in parallel and independently. However, when maintenance work is attempted to be performed on one of the printing devices 13 which is accommodated in a corresponding one of the two working compartments 15 during the concurrent execution of printing works, the operator stops the corresponding printing device 13 and thereafter opens the access door 52 for the working compartment 15 storing the relevant printing device 13. As this occurs, the inside of the working compartment 15 for which the access door 52 is opened is exposed to outside air, whereby the inside temperature of the working compartment 15 changes to a temperature which deviates from the set target inside temperature. However, since the inside of the working compartment 15 for which the access door is not opened is not exposed to the outside air, there is no change in inside temperature.

As described above, the screen printing machine 1 according to Embodiment 1 includes: the base 12; the cover member 11 provided so as to cover a portion above the base 12; the partition member 14 which divides the space surrounded by the base 12 and the cover member 11 into the two portions; the two printing devices 13 which are accommodated in the two working compartments 15, respectively, which are defined by the base 12, the cover member 11, and the partition member 14, and which are configured to execute independently the printing work on the boards PB; the air pipe 71 which branches into the two air vents 72 opened to the respective working compartments 15; and the blower unit 74 configured to blow out temperature-controlled air into each of the working compartments 15 via the air pipe 71.

In addition, a method for controlling inside temperature of the screen printing machine 1 according to Embodiment 1 includes blowing the temperature-controlled air into each of the two working compartments 15 by the blower unit 74 via the air pipe 71 which branches into the two air vents 72 opened to the respective working compartments 15.

In the screen printing machine 1 according to Embodiment 1, the space surrounded by the base 12 and the cover member 11 is divided into the two working compartments 15 by the partition member 14. Consequently, the two printing devices 13 are accommodated in the defined two working compartments 15, respectively, and the temperature-controlled air is blown into the working compartments 15 via the air pipe 71 which branches into the two air vents 72 opened to the respective working compartments 15. Therefore, even when the inside temperature in the working compartment 15 which accommodates one of the printing devices 13 changes as a result of opening of the access door 52 which corresponds to the corresponding printing device 13, the inside temperature in the working compartment 15 which accommodates the other printing device 13 hardly changes.

In the screen printing work, the temperatures of the working compartments 15 need to be maintained at the set predetermined temperature from the reason that the viscosity of the paste PT used is maintained at the proper value so as to ensure the constant quality. In this respect, according to Embodiment 1, the inside temperature in the other working compartment 15 hardly changes even when the access door 52 connected to one of the working compartment 15 is opened. Therefore, while the maintenance work is being performed on the one of the printing devices 13, the other printing device 13 can continue its printing work, thereby making it possible to increase the workability accordingly.

Embodiment 2

Figure 8:
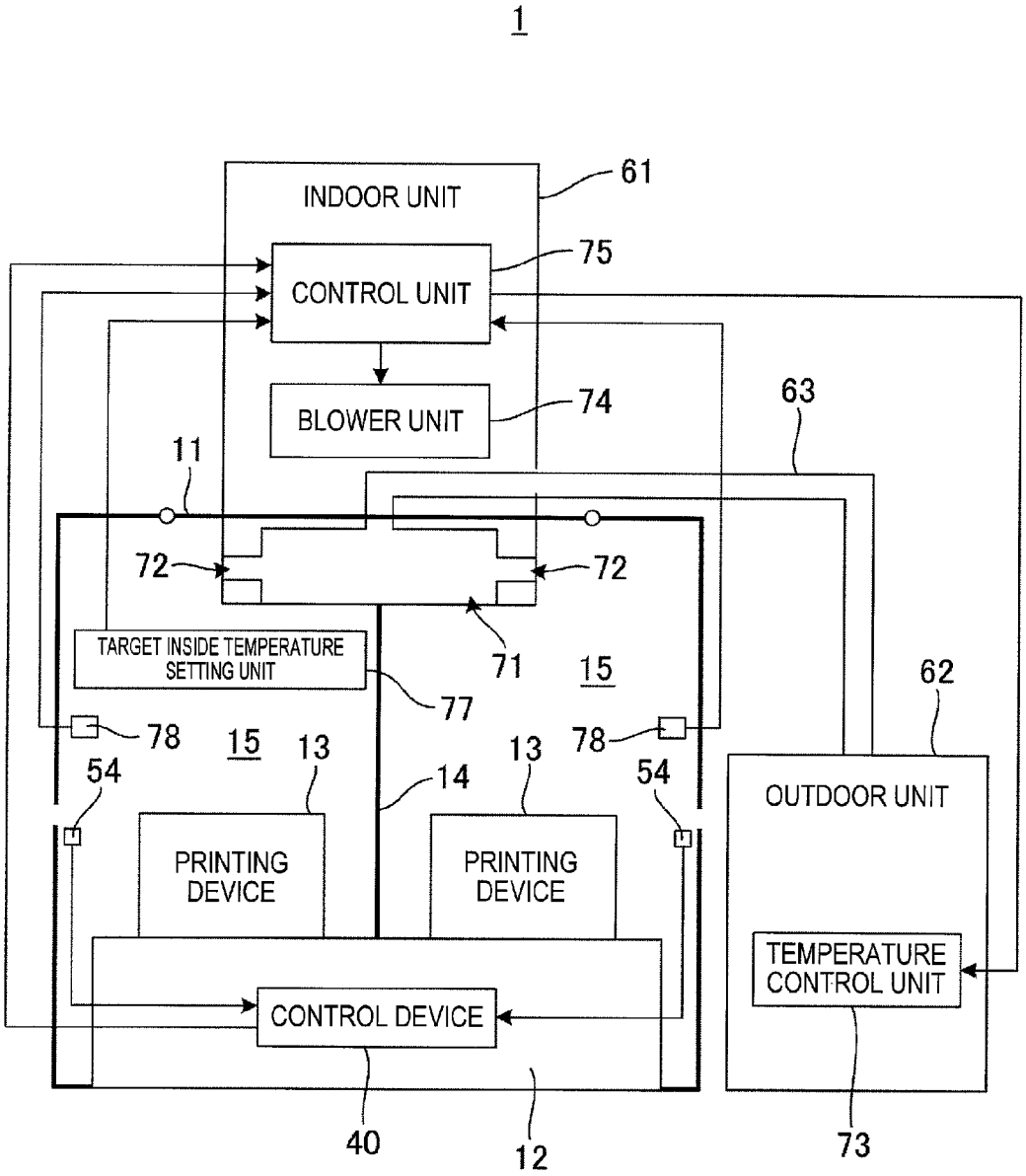
FIG. 8 is a block diagram of a temperature control unit provided in a screen printing machine according to Embodiment 2 of the invention.

FIG. 8 is a block diagram of a temperature control unit provided in a screen printing machine according to Embodiment 2 of the invention. In Embodiment 2, the air temperature detection sensor 76 in Embodiment 1 is removed. Instead, an inside temperature detection sensor 78 is provided in each of two working compartments 15. Each inside temperature detection sensor 78 detects an inside temperature of the working compartment 15 in which the same inside temperature detection sensor 78 is provided and inputs the detection result into a control unit 75 in an indoor unit 61.

In FIG. 8, signals indicating opened/closed states of two access doors 52 are input into a control device 40 in a main body portion 2, and further input into the control unit 75 in the indoor unit 61. When two door open/dose detection sensors 54 detect that neither of the two access doors 52 is opened, the control unit 75 controls the temperature of air blown out by a blower unit 74 such that either of inside temperatures of the two working compartments 15 which are detected by the two inside temperature detection sensors 78 becomes a temperature set by a target inside temperature setting unit 77. With this operation, when the access doors 52 of the two working compartments 15 are both closed, the inside temperatures of the two working compartments 15 are both maintained at a target inside temperature set by the operator.

On the other hand, when the two door open/close detection sensors 54 detect that either of the two access doors 52 is opened, the control unit 75 controls the temperature of air blown out by the blower unit 74 such that the inside temperature of the working compartment 15 for which the access door 52 is not opened, of the inside temperatures of the two working compartments 15 which are detected by the inside temperature detection sensors 78, becomes the target inside temperature set by the target inside temperature setting unit 77. Consequently, even when one of the access doors 52 is opened to change the inside temperature of the working compartment 15 connected to the opened access door 52, the inside temperature of the working compartment 15 for which the access door 52 is not opened is maintained at the target inside temperature set by the operator.

In this way, the screen printing machine 1 according to Embodiment 2 includes: the two access doors 52 provided so as to allow access to the respective working compartments 15 from the outside; the two door open/close detection sensors 54 serving as door open/close detection means for detecting the opened/closed state of each of the access doors 52; the target inside temperature setting unit 77 serving as target inside temperature setting means for setting the target inside temperature which is common to the two working compartments 15; the two inside temperature detection sensors 78 serving as inside temperature detection means for detecting the inside temperatures of the working compartments 15; and the control unit 75 configured to control the temperature of the air blown out by the blower unit 74, such that: when the two door open/close detection sensors 54 detect that neither of the two access doors 52 is not opened, one of the inside temperatures of the two working compartments 15 which is detected by the inside temperature detection sensor 78 becomes the temperature set by the target inside temperature setting unit 77; and when the two door open/close detection sensors 54 detect that either of the two access doors 52 is opened, the inside temperature of the working compartment 15 for which the access door is not opened, of the inside temperatures of the two working compartments 15 which are detected by the two inside temperature detection sensors 78, becomes the target inside temperature set by the target inside temperature setting unit 77.

In addition, a method for controlling inside temperature of the screen printing machine 1 according to Embodiment 2 includes controlling the temperature of the air blown out by the blower unit 74 such that: when the plurality of (here, two) access doors 52 provided to allow access to the respective working compartments 15 from the outside are not opened (when both the access doors 52 are dosed), one of the inside temperatures of the two working compartments 15 becomes the target inside temperature set to be common to the two working compartments 15; and when any of the plurality of access doors 52 is opened, the inside temperature of the working compartment for which the access door is not opened, of the inside temperatures of the two working compartments 15, becomes the target inside temperature.

In the screen printing machine 1 according to Embodiment 2, in a state in which the two access doors 52 are both dosed, a feedback control works such that the inside temperatures of the two working compartments 15 is caused to coincide with the target inside temperature, whereas when either of the two access doors 52 is opened, a feedback control works such that the inside temperature of the working compartment 15 for which the access door 52 is not opened is caused to coincide with the target inside temperature. Consequently, as compared with the screen printing machine 1 according to the Embodiment 1, even when the inside temperature of one of the working compartments 15 for which the access door is opened changes, it is possible to more effectively provide the advantage that the inside temperature of the other working compartment 15 for which the access door is not opened is maintained constant.

While the embodiments of the invention have been described, the invention is not limited to the embodiments described above. For example, in the embodiments, while one access door 52 is provided for each working compartment 15, this is only the example, and a plurality of access doors 52 may be provided for each working compartment 15. When a plurality of access doors 52 are provided for each working compartment 15, there may be provided the same number of door open/close sensors 54 for detecting an opened/closed state of each access door 52 as the number of access doors 52 provided, and the provided door open/close sensors 54 serve as door open/close detection means. In such a state, the control unit 75 may control the temperature of air blown out by the blower unit 74 such that: when the door open/close means detect that all of the plurality of access doors are not opened, one of the inside temperatures of the two working compartments 15 which are detected by the door open/dose detection means becomes the temperature set by the target inside temperature setting unit 77; and when the door open/close detection means detect that any of the plurality of access doors 52 is opened, the inside temperature of the working compartment 15 for which the access doors are not opened, of the inside temperatures of the two working compartments 15 which are detected by the inside temperature detection sensors 78, becomes the target inside temperature set by the target inside temperature setting unit 77.

While the invention has been described in detail and by reference to the specific embodiments, it is apparent to those skilled in the art to which the invention pertains that various changes or modifications may be made without departing from the spirit and scope of the invention.

This patent application is based on Japanese Patent Application (No. 2008-319224) filed on Dec. 16, 2008, the contents of which are to be incorporated herein by reference.

INDUSTRIAL APPLICABILITY

There are provided the screen printing machine which enables, while maintenance work is being performed on one printing device, the other printing device to continue its screen printing work, and the method for controlling the inside temperature of the screen printing machine.

DESCRIPTION OF REFERENCE SKINS

1 screen printing machine
11 cover member
12 base
13 printing device
14 partition member
15 working compartment
52 access door
54 door open/close detection sensor (door open/close detection means)
71 air pipe
72 air vent
74 blower unit
75 control unit
77 target inside temperature setting unit (target inside temperature setting means)
78 inside temperature detection sensor (inside temperature detection means)
PB board

The invention claimed is:

1. A screen printing machine comprising:

a base;

a cover member provided so as to cover a portion above the base;

a partition member which divides a space surrounded by the base and the cover member into two working compartments;

two printing devices, each of which is accommodated in each of the two working compartments, respectively, defined by the base, the cover member and the partition member, and each of which is configured to execute each of two printing works on boards independently of each other;

an air pipe which branches into two air vents opened to the respective working compartments;

a blower unit configured to blow out temperature-controlled air into each of the working compartments via the air pipe;

door open/close detection means for detecting an opened/closed state of each of access doors to allow access to each of the working compartments from outside; and a control unit configured to control a temperature of air blown out by the blower unit based on a detection result of the door open/close detection means.

2. The screen printing machine according to claim 1, comprising:

a plurality of access doors provided for the respective working compartments so as to allow access to the working compartment from outside;

target inside temperature setting means for setting a target inside temperature which is common to the two working compartments; and inside temperature detection means for detecting inside temperatures of the working compartments; wherein the control unit is configured to control a temperature of air blown out by the blower unit such that:

when the door open/close detection means detects that all of the plurality of access doors are not opened, one of the inside temperatures of the two working compartments which is detected by the inside temperature detection means becomes the temperature set by the target inside temperature setting means; and when the door open/close detection means detects that any of the plurality of access doors is opened, the inside temperature of the working compartment for which the access door is not opened, of the inside temperatures of the two working compartments detected by the inside temperature detection means, becomes the target inside temperature set by the target inside temperature setting means.

3. A method for controlling inside temperature of a screen printing machine that comprises a base, a cover member provided so as to cover a portion above the base, a partition member which divides a space surrounded by the base and the cover member into two working compartments, two printing devices, each of which is accommodated in each of the two working compartments, respectively, defined by the base, the cover member and the partition member, and each of which is configured to execute each of two printing works on boards independently of each other, and door open/close detection means for detecting an opened/closed state of each of access doors, said method comprising:

blowing temperature-controlled air into each of the working compartments by a blower unit via an air pipe which branches into two air vents opened to the respective working compartments, and controlling a temperature of air blown out by the blower unit based on a detection results of the door open/close detection means.

4. The method for controlling inside temperature of the screen printing machine according to claim 3, wherein:

the temperature of air blown out by the blower unit is controlled such that:

when the door open/close detection means detects that all of a plurality of access doors provided for the respective working compartments and configured to allow access to the respective working compartments from outside are not opened, one of the inside temperatures of the two working compartments becomes a target inside temperature set to be common to the two working compartments; and when the door open/close detection means detects that any of the plurality of access doors is opened, the inside temperature of the working compartment for which the access door is not opened, of the inside temperatures of the two working compartments, becomes the target inside temperature.

* * * * *